US008766871B2

(12) United States Patent
Hamabe

(10) Patent No.: US 8,766,871 B2
(45) Date of Patent: Jul. 1, 2014

(54) ANTENNA APPARATUS AND DISPLAY APPARATUS

(75) Inventor: Taichi Hamabe, Hyogo (JP)

(73) Assignee: Panasonic Corporation, Osaka (JP)

( * ) Notice: Subject to any disclaimer, the term of this patent is extended or adjusted under 35 U.S.C. 154(b) by 155 days.

(21) Appl. No.: 13/520,040

(22) PCT Filed: Jul. 5, 2011

(86) PCT No.: PCT/JP2011/003823

§ 371 (c)(1),
(2), (4) Date: Jun. 29, 2012

(87) PCT Pub. No.: WO2012/004977

PCT Pub. Date: Jan. 12, 2012

(65) Prior Publication Data

US 2012/0280887 A1 Nov. 8, 2012

(30) Foreign Application Priority Data

Jul. 6, 2010 (JP) ..... 2010-153603

(51) Int. Cl.
*H01Q 9/42* (2006.01)
*H01Q 21/06* (2006.01)
*H01Q 21/00* (2006.01)

(52) U.S. Cl.
CPC ..... *H01Q 9/42* (2013.01); *H01Q 21/06* (2013.01); *H01Q 21/00* (2013.01)
USPC ..... 343/893; 343/702

(58) Field of Classification Search
CPC ..... H01Q 9/42; H01Q 21/06; H01Q 21/00
USPC ..... 343/702, 893, 700 MS
See application file for complete search history.

(56) References Cited

U.S. PATENT DOCUMENTS

| | | | | |
|---|---|---|---|---|
| 7,656,360 | B2 * | 2/2010 | Hirabayashi | 343/818 |
| 2005/0153756 | A1 | 7/2005 | Sato et al. | |
| 2009/0046019 | A1 | 2/2009 | Sato | |
| 2012/0212389 | A1 * | 8/2012 | Aizawa et al. | 343/853 |
| 2012/0287012 | A1 * | 11/2012 | Aizawa | 343/853 |

FOREIGN PATENT DOCUMENTS

| | | | |
|---|---|---|---|
| EP | 1 603 189 | A1 | 12/2005 |
| EP | 2 178 170 | A1 | 4/2010 |
| JP | 2000-174529 | | 6/2000 |
| JP | 2005-203878 | | 7/2005 |
| JP | 2005-347882 | | 12/2005 |

(Continued)

OTHER PUBLICATIONS

International Search Report issued in International Patent Application No. PCT/JP2011/003823 dated Oct. 11, 2011.

*Primary Examiner* — Hoanganh Le
(74) *Attorney, Agent, or Firm* — McDermott Will & Emery LLP

(57) ABSTRACT

Provided is an antenna device, including insulating base substrate (190), first monopole antenna (110), and second monopole antenna (120), the antennas being disposed on insulating base substrate (190), wherein first monopole antenna (110) and second monopole antenna (120) have: first portions extended in a same direction from power feeding ends connected to first power feeding section (180); and second portions extended from the first portions separately to left and right sides, and first passive element (130) is disposed between the first portion of first monopole antenna (110) and the first portion of second monopole antenna (120).

4 Claims, 6 Drawing Sheets

(56) References Cited

FOREIGN PATENT DOCUMENTS

| | | |
|---|---|---|
| JP | 2007-281906 | 10/2007 |
| JP | 2008-124865 | 5/2008 |
| JP | 2009-246568 | 10/2009 |
| JP | 2010-098411 | 4/2010 |
| WO | WO 2006/038432 A1 | 4/2006 |

* cited by examiner

ANTENNA APPARATUS AND DISPLAY APPARATUS

RELATED APPLICATIONS

This application is the U.S. National Phase under 35 U.S.C. §371 of International Application No. PCT/JP2011/003823, filed on Jul. 5, 2011, which in turn claims the benefit of Japanese Application No. 2010-153603, filed on Jul. 6, 2010, the disclosures of which Applications are incorporated by reference herein.

TECHNICAL FIELD

The instant application relates to an antenna device having a plurality of antennas, and to a display device including an antenna device.

BACKGROUND

Portable display devices have been being widespread, which are capable of receiving terrestrial digital broadcasting signal and the like. In each of these display devices, it is necessary to mount an antenna, which receives airwaves, in an inside or outside of a cabinet which composes the device. In particular, as a method of realizing high-sensitivity reception, a diversity method, in which a plurality of antennas are provided, is used. Moreover, a variety of efforts have been made as to which shape the plurality of antennas are formed into and how the antennas are mounted (for example, refer to PTLs 1 to 3).

CITATION LIST

Patent Literature

PTL 1: Unexamined Japanese Patent Publication No. 2005-347882

PTL 2: Unexamined Japanese Patent Publication No. 2007-281906

PTL 3: Unexamined Japanese Patent Publication No. 2008-124865

SUMMARY

A technology disclosed herein is an antenna device, including an insulating base substrate, a first monopole antenna, and a second monopole antenna, the antennas being disposed on the insulating base substrate, wherein the first monopole antenna and the second monopole antenna have: first portions extended in a same direction from power feeding ends thereof connected to a power feeding section; and second portions extended from the first portions separately to left and right sides, and a passive element is disposed between the first portion of the first monopole antenna and the first portion of the second monopole antenna.

With this configuration, an antenna device can be provided, which is capable of arranging a plurality of antennas having the same frequency band close to one another in a loosely coupling manner, and moreover, a display device including the antenna device can be provided.

DETAILED DESCRIPTION

A description is made of a display device having an antenna device according to an exemplary embodiment with reference to the drawings.

Figure 1A:
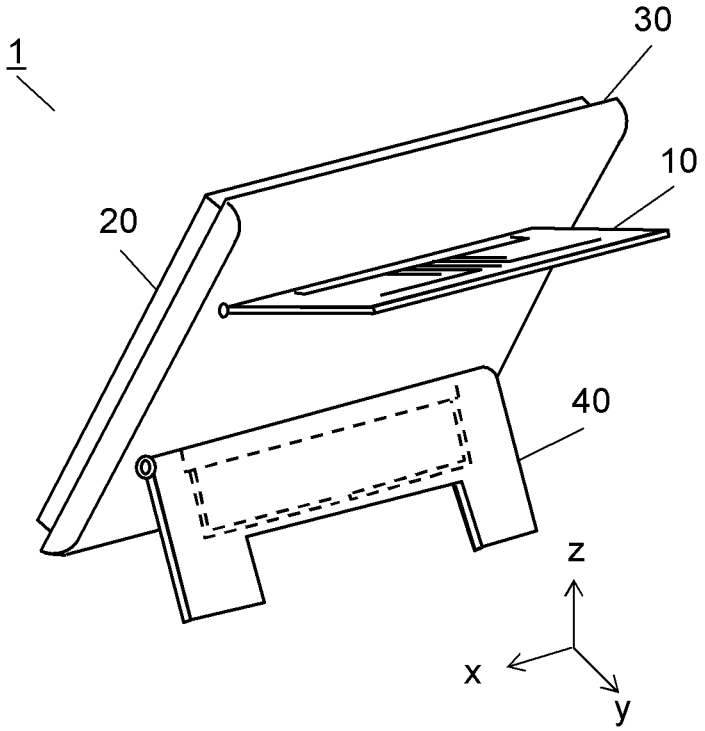
FIG. 1A is a perspective view of an exterior appearance of a display device.
Figure 1B:
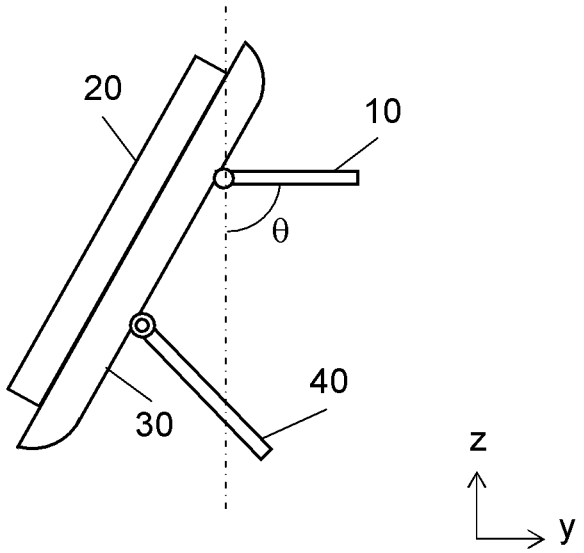
FIG. 1B is a side view of the display device.

First, a description is made of a configuration of a display device 1 according to this exemplary embodiment. FIG. 1A is a perspective view showing an exterior appearance of the display device 1. FIG. 1B is a side view of the display device 1.

The display device 1 includes: an antenna device 10; a liquid crystal display (LCD) 20 as a display; a main body 30 that houses a variety of electric circuits therein; and a support member 40. Note that, in this exemplary embodiment, a horizontal direction of an image display screen of the LCD 20 is defined as an x-axis, a vertical direction of the display device 1 is defined as a z-axis, and a direction perpendicular to the x-axis and the z-axis is defined as a y-axis. Moreover, a right orientation of the image display surface of the LCD 20 when viewed from the front is defined as a positive orientation of the x-axis, and a left orientation of the image display surface thereof when viewed from the front is defined as a negative orientation of the x-axis. Moreover, an upper orientation of the display device 1 in the vertical direction is defined as a positive orientation of the z-axis, and a lower orientation thereof in the vertical direction is defined as a negative orientation of the z-axis. Furthermore, an orientation of the LCD 20 on an image display surface side is defined as a negative orientation of the y-axis, and an orientation thereof on a side opposite to the image display surface is defined as a positive orientation of the y-axis.

The LCD 20 includes the image display surface in the negative orientation of the y-axis, and displays a video. The LCD 20 has a metal frame (not shown) that surrounds the image display surface from a back surface side. The LCD 20 is located on a front surface side of the main body 30. Note that, the LCD 20 is an example of a display. For example, an organic EL display and the like may be used.

The main body 30 includes an exterior cabinet made of a resin substrate. In the exterior cabinet, the main body 30 has an electric circuit board (not shown) including a tuner circuit that receives terrestrial digital broadcasting, and the like. The main body 30 transfers an electric signal, which is received by the antenna device 10, to a tuner circuit (not shown), and takes out desired video data. The main body 30 sends the taken-out video data to the LCD 20, and allows the LCD 20 to display an image. Besides this, the main body 30 has, in the exterior cabinet, a power supply circuit and an audio circuit, a recording device and a playback device, and further, a heat radiating metal member for reducing heat generated in the electric circuit board and the like (any not shown).

The support member 40 may be mainly made of a resin substrate. The support member 40 is rotatably fixed to the main body 30 and supports the LCD 20 and main body 30 to allow the LCD 20 and the main body 30 stand upward. The support member 40 may include a power feeding section and an antenna in an inside thereof. Details of the support member 40 will be described later.

The antenna device 10 includes a plurality of antennas on one board, and is substantially rectangular plate shape. The antenna device 10 includes a power feeding section, to which a power feeding ends of the respective antennas are connected, on one end side portion of the rectangular shape. In the antenna device 10, a support end A (see FIG. 2) thereof as a side on which the power feeding section is provided is attached onto a back surface of the main body 30. The antenna device 10 is rotatably attached onto a back surface side of the LCD 20.

In this exemplary embodiment, the antenna device 10 is rotatably attached onto the back surface of the main body 30. More specifically, the antenna device 10 is rotatable on the y-z plane about such a support portion as a fulcrum. In such a way, the viewer can appropriately adjust an orientation of the antenna device 10. Note that, as shown in FIG. 1B, in the display device 1 of this exemplary embodiment, at the time when the display device 1 is used, a radio wave can be preferably received when the antenna device 10 is rotated in a substantially horizontal direction (a position, where θ of FIG. 1B is equal to 90 degrees (θ=90°), is the horizontal direction). At this time, the image display surface of the LCD 20 faces a side opposite to the antenna device 10. Note that θ in FIG. 1B is an inclination angle with respect to the vertical direction on the y-z plane.

Figure 2:
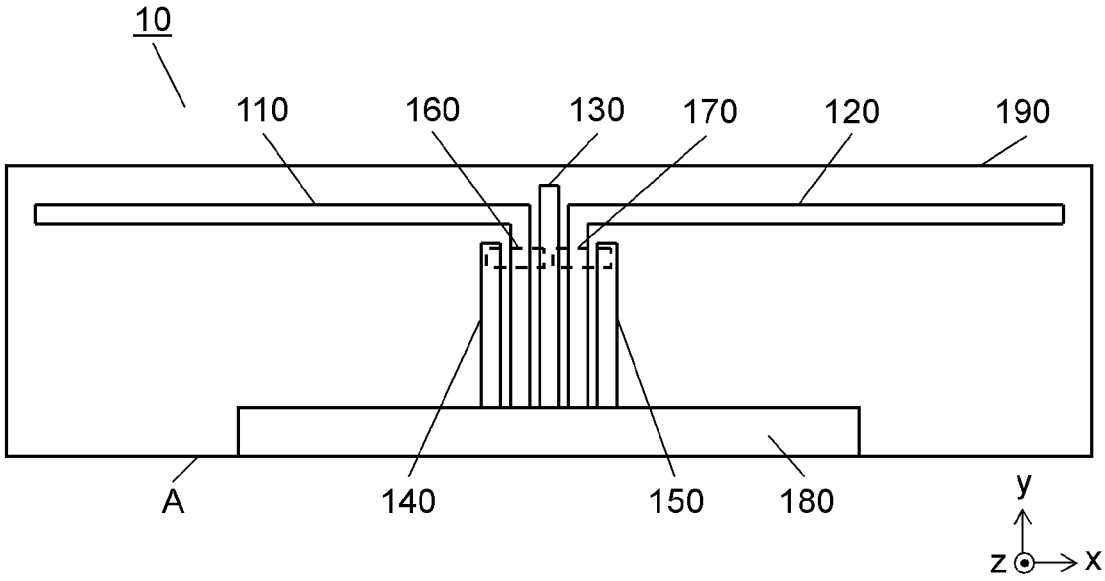
FIG. 2 is a view showing a configuration of an antenna device.

Next, a description is made in detail of the configuration of the antenna device 10 with reference to FIG. 2. FIG. 2 is a view showing the configuration of the antenna device 10. Note that, in the following, the description is made on the assumption that a principal surface of the antenna device 10 is located in an orientation parallel to an x-z plane (θ=90° in FIG. 1B) for the sake of convenience.

In the antenna device 10, a first monopole antenna 110, a second monopole antenna 120, a first passive element 130, a second passive element 140, and a third passive element 150 are formed by predetermined shape patterns of metal such as copper on flat plate-like an insulating base substrate 190 made of acrylic resin or the like. Moreover, the antenna device 10 includes a power feeding section 180 as a first power feeding section on an end portion of the insulating base substrate 190. In the first monopole antenna 110 and the second monopole antenna 120, a power feeding end of each thereof is connected to the power feeding section 180.

As a method of connecting respective the antennas 110 and 120 and the power feeding section 180 to each other, for example, such power feeding ends of respective the antennas 110 and 120 and terminals of the power feeding section 180 just need to be connected to each other by springs and the like. As a method of connecting respective the passive elements 130, 140, and 150 and the terminals of the power feeding section 180 to each other, for example, power feeding ends of respective antennas and terminals of the power feeding section 180 just need to be connected to each other by springs and the like. In this exemplary embodiment, a width of conductor patterns, which compose the first monopole antenna 110, the second monopole antenna 120, the first passive element 130, the second passive element 140, and the third passive element 150 is constant at 3 mm, and these antennas and elements are formed at such a constant width.

Moreover, the antenna device 10 includes a jumper resistor 160 that connects the first passive element 130 and an end portion of the second passive element 140 to each other. Furthermore, the antenna device 10 includes a jumper resistor 170 that connects the first passive element 130 and an end portion of the third passive element 150 to each other. These jumper resistors 160 and 170 may be zero-ohm chip resistors for allowing the passive elements to conduct to each other. The jumper resistors 160 and 170 may not be connected to the first monopole antenna 110 and the second monopole antenna 120.

Specifically, the jumper resistors 160 and 170 are provided so as to insulate and stride the first monopole antenna 110 and the second monopole antenna 120. The jumper resistors 160 and 170 may be attached, by soldering, onto a surface in the base substrate 190, which is on an opposite side with a surface on which there are formed the first monopole antenna 110, the second monopole antenna 120, the first passive element 130, the second passive element 140, and the third passive element 150.

At this time, conductor vias, which connect terminals of the jumper resistors 160 and 170 and the respective passive elements to each other, may be formed so as to penetrate the base substrate 190. Note that the jumper resistors 160 and 170 are examples of a first connection member and a second connection member, respectively. For example, the jumper resistors may be metal wires, or metal foil tapes. In short, the jumper resistors 160 and 170 may simply act as an electrical conductor between the respective passive elements.

Here, the first monopole antenna 110, the second monopole antenna 120, the first passive element 130, the second passive element 140, and the third passive element 150 can be formed, for example, by printing of metal patterns, pasting of metal films, pasting of metal lines, etching of metal or the like. For example, the base substrate 190 may be made of an acrylic substrate, and in this exemplary embodiment, an outer shape of the base substrate 190 is a substantially rectangular flat plate shape with a dimension of 218 mm×55 mm, and the base substrate 190 may have a recessed portion at which the power feeding section 180 is located. The power feeding section 180 may be provided integrally with the base substrate 190.

Figure 3:
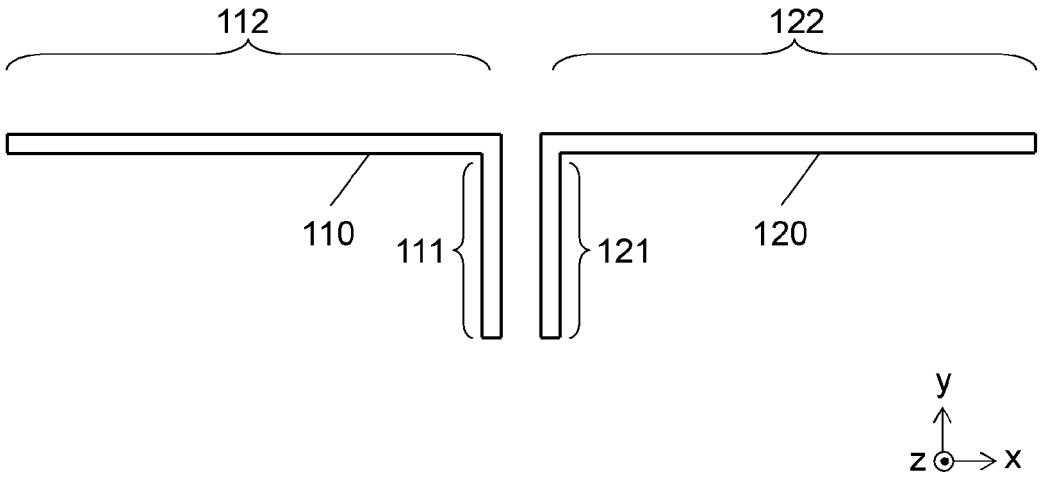
FIG. 3 is a view showing configurations of a first monopole antenna and a second monopole antenna.

FIG. 3 is a view showing detailed configurations of the first monopole antenna 110 and the second monopole antenna 120. The first monopole antenna 110 includes: a first portion 111 extended in a y-axis direction from the power feeding end connected to the power feeding section 180; and a second portion 112 bent and extended in the negative direction of the x-axis from the first portion 111. The second monopole antenna 120 includes: a first portion 121 extended in the y-axis direction from the power feeding end connected to the power feeding section 180; and a second portion 122 bent and extended in the positive direction of the x-axis from the first portion 121.

That is, the first portion 111 of the first monopole antenna 110 is extended in a lateral direction (first direction) of the base substrate 190 from the power feeding end connected to the power feeding section 180. The first portion 121 of the second monopole antenna 120 is extended in the lateral direction (first direction) of the base substrate 190 from the power feeding end connected to the power feeding section 180. Note that "extended in the lateral direction" or "extended in the longitudinal direction" indicates a direction in which the respective elements are mainly extended, and include the case where the respective elements are partially bent. The first portion 111 of the first monopole antenna 110 and the first portion 121 of the second monopole antenna 120 are extended in a state of facing each other.

Moreover, in the first monopole antenna 110, the first portion 111, and the second portion 112 are perpendicular to each other, and in the second monopole antenna 120, the first portion 121 and the second portion 122 are perpendicular to each other.

The first portion 111 of the first monopole antenna 110 and the first portion 121 of the second monopole antenna 120 are disposed parallel to each other. A length of the first portion 111 of the first monopole antenna 110 may be 45 mm. Moreover, a length of the first portion 121 of the second monopole antenna 120 may be 45 mm.

On an end portion of the first portion 111 of the first monopole antenna 110 on an opposite side with the power feeding section 180, the second portion 112 of the first monopole antenna 110 is bent by 90 degrees in the negative orientation of the x-axis, and is extended by 100 mm.

That is, the first monopole antenna 110 includes: the first portion 111 extended in the same direction from the power feeding end connected to the power feeding section 180; and the second portion 112 extended from this first portion 111 separately to left and right sides.

On an end portion of the first portion 121 of the second monopole antenna 120 on the opposite side with the power feeding section 180, the second portion 122 of the second monopole antenna 120 is bent by 90 degrees in the positive orientation of the x-axis, and is extended by 100 mm.

That is, the second monopole antenna 120 includes: a first portion 121 extended in the same direction from the power feeding end connected to the power feeding section 180; and a second portion 122 extended from the first portion 121 separately to the left and right sides.

Note that the first monopole antenna 110 and the second monopole antenna 120 are antennas which set therein a terrestrial digital broadcasting band (473 MHz to 767 MHz) as a desired service band.

Figure 4:
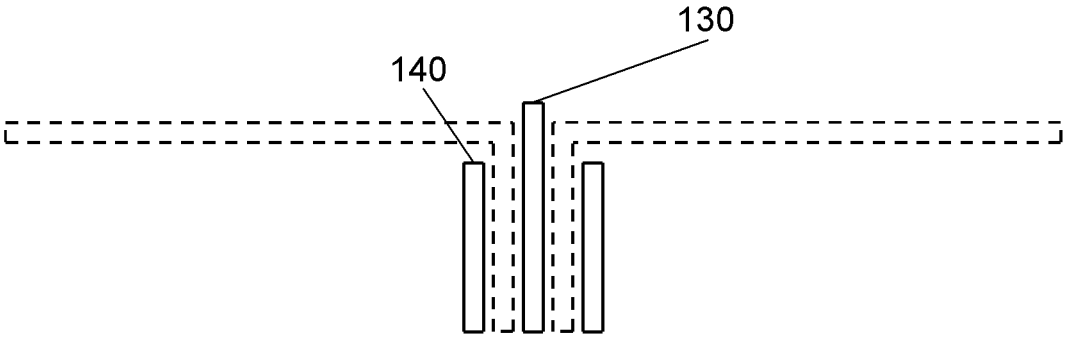
FIG. 4 is a view showing configurations of the first monopole antenna and the second monopole antenna.

Next, a description is made of the first passive element 130, the second passive element 140, and the third passive element 150 with reference to FIG. 4. The first passive element 130, the second passive element 140, and the third passive element 150 are provided on the base substrate 190 so as to be parallel to the first portion 111 of the first monopole antenna 110 and the first portion 121 of the second monopole antenna 120.

First, a description is made of the first passive element 130. The first passive element 130 is extends in the lateral direction (first direction) of the base substrate 190 from a ground end thereof connected to the ground layer of the power feeding section 180. The first passive element 130 is disposed so as to be extended between the first portion 111 of the first monopole antenna 110 and the first portion 121 of the second monopole antenna 120. The first passive element 130 may extend by 45 mm in the positive orientation of the y-axis from the power feeding section 180.

Next, a description is made of the second passive element 140 and the third passive element 150. The second passive element 140 is extended in the lateral direction (first direction) of the base substrate 190 from a ground end thereof connected to the ground layer of the power feeding section 180. The second passive element 140 is formed on the base substrate 190 so as to sandwich, with the first passive element 130, the first portion 111 of the first monopole antenna 110. The second passive element 140 may extend by 35 mm in the positive orientation of the y-axis from the power feeding section 180.

The third passive element 150 extends in the lateral direction (first direction) of the base substrate 190 from a ground end thereof connected to the ground layer of the power feeding section 180. The third passive element 150 is formed on the base substrate 190 so as to sandwich, with the first passive element 130, the first portion 121 of the second monopole antenna 120. The third passive element 150 is extended by 35 mm in the positive orientation of the y-axis from the power feeding section 180.

Figure 5:
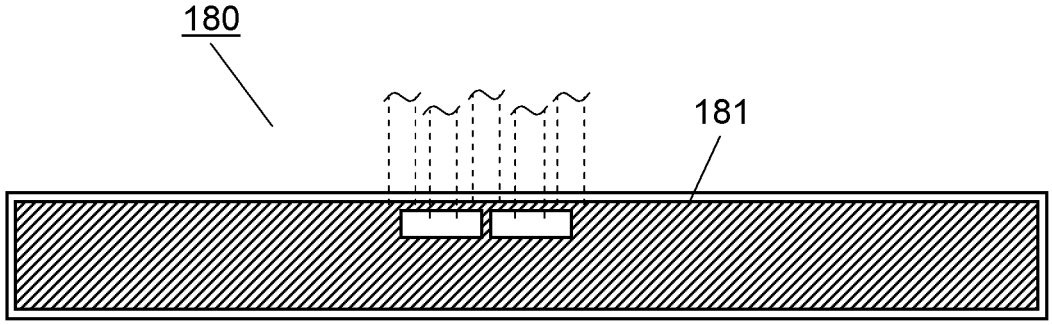
FIG. 5 is a view showing a configuration of a power feeding section.

Next, a description is made of the power feeding section 180 with reference to FIG. 5. FIG. 5 is a schematic view showing a configuration of the power feeding section 180.

The power feeding section 180 is formed of a double-layer board, which is single and has a conductive layer and a dielectric layer. In the power feeding section 180, there are packaged a matching circuit and a low noise amplifier (LNA) circuit (not shown). Moreover, to the power feeding section 180, there are connected the respective the power feeding ends of the first monopole antenna 110 and the second monopole antenna 120. In the power feeding section 180, in the conductive layer, a ground area 181 (ground layer) is formed, to which the first passive element 130, the second passive element 140 and the third passive element 150 are connected. The ground area 181 is a conductive pattern that applies an electrical ground potential to the first monopole antenna 110 and the second monopole antenna 120.

The ground area 181 is extended in a direction (direction of the x-axis in this exemplary embodiment) where the second portion 112 of the first monopole antenna 110 and the second portion 122 of the second monopole antenna 120 are extended.

Figure 6:
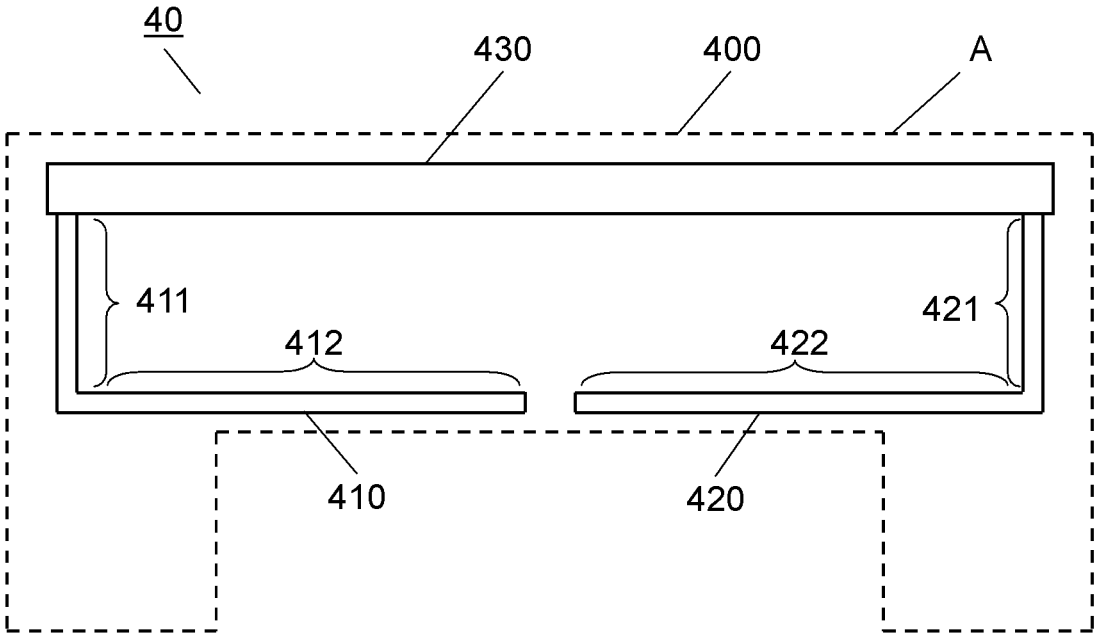
FIG. 6 is a view showing configurations of a third monopole antenna and a fourth monopole antenna.

Next, a description is made in detail of a configuration of the support member 40 with reference to FIG. 6.

In an inside of an exterior package 400 made of a resin substrate, the support member 40 includes: the third monopole antenna 410; a fourth monopole antenna 420; and a power feeding section 430 as a second power feeding section. In FIG. 6, the exterior package 400 is shown by a dotted line, and the third monopole antenna 410, the fourth monopole antenna 420, and the power feeding section 430, which are built therein, are shown by solid lines.

The third monopole antenna 410 and the fourth monopole antenna 420 have a first portions 411 and 421, respectively, which are extended in the same direction from the power feeding ends thereof connected to the power feeding section 430. Moreover, the third monopole antenna 410 and the fourth monopole antenna 420 have the second portions 412 and 422, respectively, which are extended from the first portions 411 and 412 in directions where the second portions 412 and 422 face each other.

In this exemplary embodiment, the third monopole antenna 410 includes: the first portion 411 extended by 45 mm from the power feeding section 430; and the second portion 412 bent by 90 degrees in the positive orientation of the x-axis from an end portion of the first portion 411 and extended by 100 mm. The fourth monopole antenna 420 includes: the first portion 421 extended by 45 mm from the power feeding section 430; and the second portion 422 bent by 90 degrees in the negative orientation of the x-axis from an end portion of the first portion 421 and extended by 100 mm.

FIGS. 7A to 7D are diagrams showing radiation patterns of horizontal polarizations of the respective antennas when the display device 1 is viewed from the positive direction side of the z-axis. Note that, for each of the radiation patterns of FIGS. 7A to 7D, the case is shown, when an angle made by the antenna device 10 with the z-axis is 90 degrees (θ=90° in FIG. 1B). Moreover, a center of each diagram of FIGS. 7A to 7D coincides with a center of the display device 1.

Figure 7A:
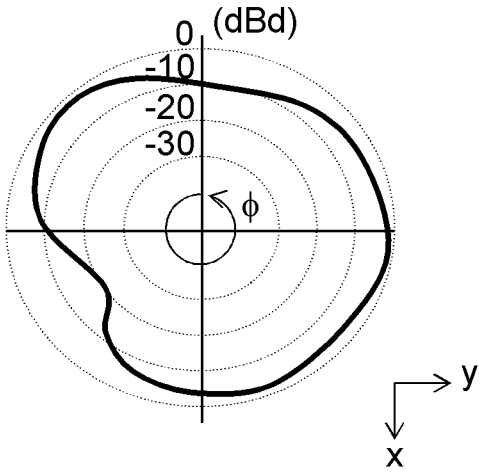
FIG. 7A is a diagram showing a radiation pattern of a horizontal polarization of each antenna.

FIG. 7A shows a radiation pattern of the first monopole antenna 110. The first monopole antenna 110 has high gains in the back surface direction (positive orientation of the y-axis) of the display device 1 and a ϕ 45° direction of the display device 1. Here, ϕ is an angle shown in FIG. 7A, and is an angle when the negative direction of the x-axis is taken as a reference (0 degree) on the x-y plane.

Figure 7B:
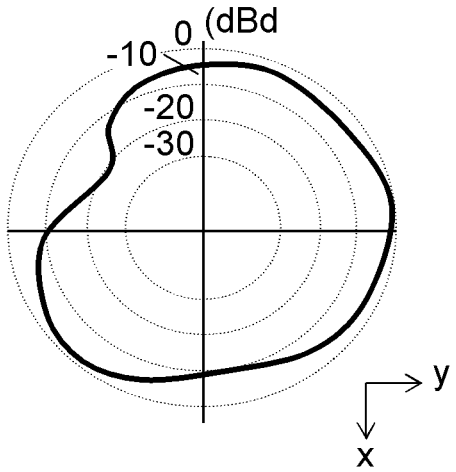
FIG. 7B is a diagram showing a radiation pattern of a horizontal polarization of each antenna.

FIG. 7B shows a radiation pattern of the second monopole antenna 120. The second monopole antenna 120 has high gains in the back surface direction (positive orientation of the y-axis) of the display device 1 and a ϕ 135° direction of the display device 1.

Figure 7C:
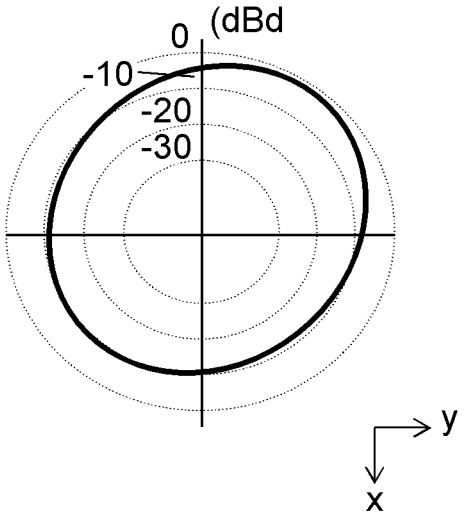
FIG. 7C is a diagram showing a radiation pattern of a horizontal polarization of each antenna.

FIG. 7C shows a radiation pattern of the third monopole antenna 410. The third monopole antenna 410 has a high gain in a ϕ 315° direction of the display device 1.

Figure 7D:
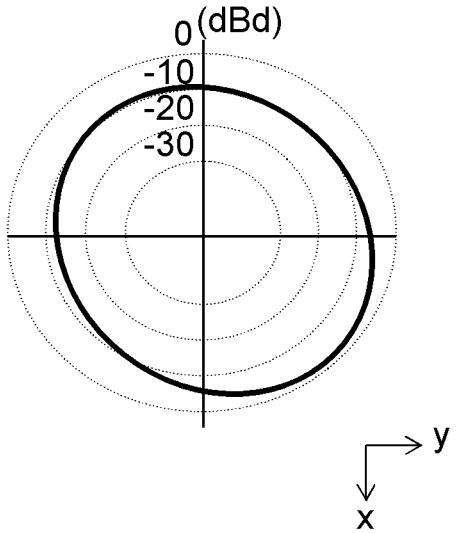
FIG. 7D is a diagram showing a radiation pattern of a horizontal polarization of each antenna.

FIG. 7D shows a radiation pattern of the fourth monopole antenna 420. The fourth monopole antenna 420 has a high gain in a ϕ 225° direction of the display device 1.

In the antenna device 10 as described above, the first monopole antenna 110 and the second monopole antenna 120 have strong directivities in directions different from each other. Therefore, reduction of the gain, which is caused by coupling of the first monopole antenna 110 and the second monopole antenna 120, can be suppressed.

Moreover, in the display device 1, the first monopole antenna 110, the second monopole antenna 120, the third monopole antenna 410, and the fourth monopole antenna 420 have strong directivities in directions different from one another. Therefore, coupling of the first monopole antenna 110, the second monopole antenna 120, the third monopole antenna 410, and the fourth monopole antenna 420 can be reduced. As a result, the reduction of the gain can be suppressed.

Figure 8A:
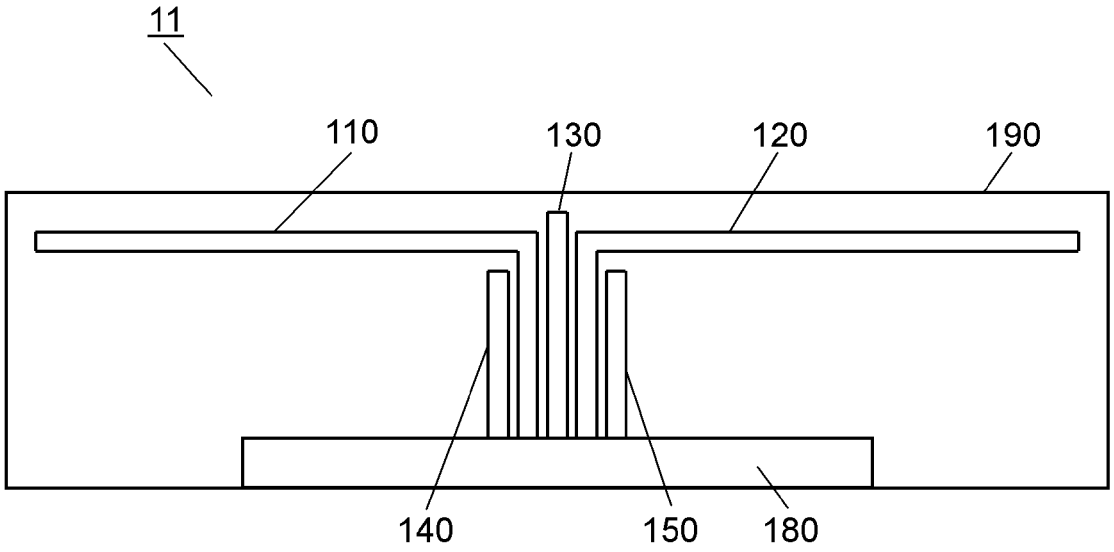
FIG. 8A is a view showing a modification example.
Figure 8B:
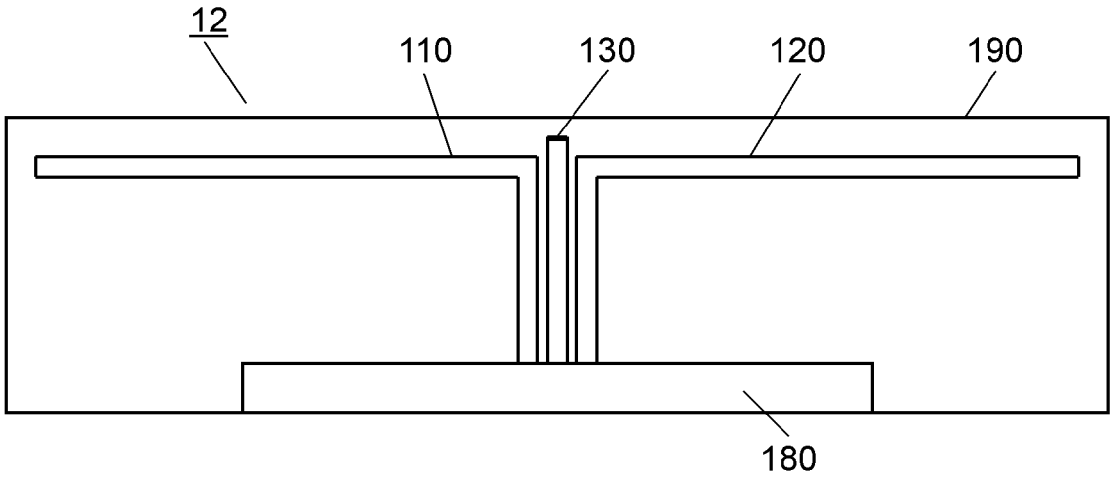
FIG. 8B is a view showing another modification example.

Note that, in this exemplary embodiment, the antenna device 10 includes jumper resistors 160 and 170, second passive elements 140, and third passive elements 150; however, these are not always essential components. For example, as shown in an antenna device 11 of FIG. 8A, a configuration may be adopted, in which the jumper resistors 160 and 170 shown in FIG. 2 are not present, and as shown in an antenna device 12 of FIG. 8B, a configuration may be adopted, in which the jumper resistors 160 and 170, the second passive element 140, and the third passive element 150, which are shown in FIG. 2, are not present. Even in these configurations, the first passive element 130 is provided, whereby the reduction of the gain, which is caused by the coupling of the first monopole antenna 110 and the second monopole antenna 50, can be suppressed. However, the reduction of the gain can be suppressed more in the case where the jumper resistors 160 and 170, the second passive element 140, and the third passive element 150 are provided as shown in this exemplary embodiment.

As described above, the antenna device 10 included in the display device 1 according to this exemplary embodiment includes: the power feeding section 180; and the base substrate 190 on which the first monopole antenna 110, the second monopole antenna 120, and the first passive element 130 are formed. Then, the first monopole antenna 110 and the second monopole antenna 120 have the first portions 111 and 121 extended in the same direction from the power feeding ends connected to the power feeding section 180, respectively. Moreover, the first monopole antenna 110 and the second monopole antenna 120 have the second portions 112 and 122 extended from the first portions 111 and 121 separately to the left and right sides, respectively. The first passive element 130 is disposed between the first portion 111 of the first monopole antenna 110 and the first portion 121 of the second monopole antenna 120.

In such a configuration, the first portions 111 and 121 are present, whereby the second portions 112 and 122 can be separated from each other to the left and right sides after being left by a predetermined distance from the power feeding section 180 side, can ensure a distance from the ground present on the power feeding section 180 side, and can reduce the coupling. Moreover, the first passive element 130 is present, whereby the first monopole antenna 110 and the second monopole antenna 120, which are the antennas having the same frequency band, can be disposed close to each other in a loosely coupled manner.

Moreover, the antenna device 10 includes: the second passive element 140 formed on the base substrate 190 so as to sandwich, with the first passive element 130, the first portion 111 of the first monopole antenna 110; and third the passive element 150 formed on the base substrate 190 so as to sandwich, with the first passive element 130, the first portion 121 of the second monopole antenna 120.

In such a way, the coupling of the first portions 111 and 121 to other portions can be further reduced, and the gain of the antenna device 10 can be further enhanced.

Moreover, the antenna device 10 includes: the jumper resistor 160 that electrically connects the first passive element 130 and the second passive element 140 to each other; and the jumper resistor 170 that electrically connects the first passive element 130 and the third passive element 150 to each other.

In such a way, the ground potential of each of the passive elements can be stabilized, and the coupling of the first portions 111 and 121 to other portions can be further reduced, and as a result, the gain of the antenna device 10 can be further enhanced.

Moreover, in the antenna device 10, the power feeding section 180 includes a ground layer 181 formed on the board. The ground layer 181 is extended in the direction where the second portion 112 of the first monopole antenna 110 and the second portion 122 of the second monopole antenna 120 are extended.

In such a way, a current flowing through the ground layer 181 flows in the same direction as that of the second portions 112 of the respective monopole antennas, and accordingly, an antenna, in which the horizontal polarization component is further enhanced, can be formed. Moreover, when the ground layer 181 becomes large, the ground potential can be further stabilized.

Needless to say, the instant application is not limited to the above-described exemplary embodiment, is modifiable in various ways, and such a variety of modifications are also incorporated in the scope of the instant application.

INDUSTRIAL APPLICABILITY

The technology disclosed herein is suitable for sensitivity enhancement of an instrument having a plurality of antennas.

REFERENCE MARKS IN THE DRAWINGS

1 display device
10, 11, 12 antenna device
20 LCD
30 main body
40 support member
110 first dipole antenna

111 first portion
112 second portion
120 second dipole antenna
121 first portion
122 second portion
130 first passive element
140 second passive element
150 third passive element
160, 170 jumper resistor
180 power feeding section
190 base substrate
400 exterior package
410 third monopole antenna
411 first portion
412 second portion
420 fourth monopole antenna
421 first portion
422 second portion
430 power feeding section

What is claimed is:

1. An antenna device, comprising:
an insulating base substrate;
a first monopole antenna;
a second monopole antenna;
a first passive element; and
a second passive element, wherein:
the first monopole antenna and the second monopole antenna are disposed on the insulating base substrate,
the first monopole antenna includes:
a first portion extended from a power feeding end connected to a power feeding section; and
a second portion extended from another end of the first portion to left side,
the second monopole antenna includes:
a first portion extended in a same direction as the first portion of the first monopole antenna from a power feeding end connected to the power feeding section; and
a second portion extended from another end of the first portion to right side, and
the first passive element is disposed between the first portion of the first monopole antenna and the first portion of the second monopole antenna,
the first passive element and the second passive element sandwiches either one of the first portion of the first monopole antenna or the first portion of the second monopole antenna.

2. The antenna device according to claim 1, wherein
the first passive element and the second passive element are electrically connected to each other by a connection member.

3. A display device, comprising:
an antenna device including an insulating base substrate, a first monopole antenna, a second monopole antenna, a first passive element and a second passive element, the first monopole antenna and the second monopole antenna being disposed on the insulating base substrate;
a main body having an electric circuit that converts, into an electric signal, a radio wave received by the antenna device; and
a display that receives the electric signal coming from the main body and displays an image, wherein:
the first monopole antenna includes:
a first portion extended from a power feeding end connected to a power feeding section; and
a second portion extended from another end of the first portion to left side,
the second monopole antenna includes:
a first portion extended in a same direction as the first portion of the first monopole antenna from a power feeding end connected to the power feeding section; and
a second portion extended from another end of the first portion to right side, and
and
the first passive element is disposed between the first portion of the first monopole antenna and the first portion of the second monopole antenna, and
the first passive element and the second passive element sandwiches either one of the first portion of the first monopole antenna or the first portion of the second monopole antenna.

4. The display device according to claim 3, wherein
the first passive element and the second passive element are electrically connected to each other by a connection member.

* * * * *